United States Patent [19]

Woodson et al.

[11] Patent Number: 4,821,467

[45] Date of Patent: Apr. 18, 1989

[54] CONTROL SYSTEM FOR LIQUID PROPELLED ABRASIVE CLEANING

[75] Inventors: Jerry P. Woodson; R. Craig Martin, both of Houston; Bryce T. Baker, Bellaire, all of Tex.

[73] Assignee: Whitemetal Inc., Houston, Tex.

[21] Appl. No.: 872,095

[22] Filed: Jun. 6, 1986

[51] Int. Cl.[4] ..... B24C 7/00

[52] U.S. Cl. ..... 51/436; 51/410

[58] Field of Search ..... 51/410, 415, 436, 427, 51/321, 319–320

[56] References Cited

U.S. PATENT DOCUMENTS

| | | | |
|---|---|---|---|
| 2,317,837 | 4/1943 | Webster | 51/415 |
| 3,201,901 | 8/1965 | Pauli | 51/436 |
| 3,834,082 | 9/1974 | Grudzinski | 51/436 |
| 3,858,358 | 1/1975 | Stachowiak et al. | 51/436 |
| 4,517,774 | 5/1985 | Dudding | 51/436 |
| 4,610,113 | 9/1986 | Fageroos | 51/410 |
| 4,689,923 | 9/1987 | Goudeaux et al. | 51/410 |

*Primary Examiner*—Frederick R. Schmidt
*Assistant Examiner*—Maurina Rachuba
*Attorney, Agent, or Firm*—Dodge, Bush & Moseley

[57] ABSTRACT

A liquid-propelled abrasive cleaning apparatus comprising a nozzle for applying a high pressure stream of water and propelled sand particles to a surface to be cleaned; a pump for furnishing water under high pressure to the nozzle, the pump being of a kind which may be driven by a pressurized fluid medium and having a discharge outlet; a first conduit for connecting the outlet to the nozzle; a second conduit for delivering the medium to the pump; a normally closed valve in the first conduit; a pneumatic actuator for opening the valve; and a control device disposed in proximity with the nozzle for enabling pressure to be applied to the actuator to open the valve only when the nozzle is in use.

26 Claims, 3 Drawing Sheets

FIG. 2
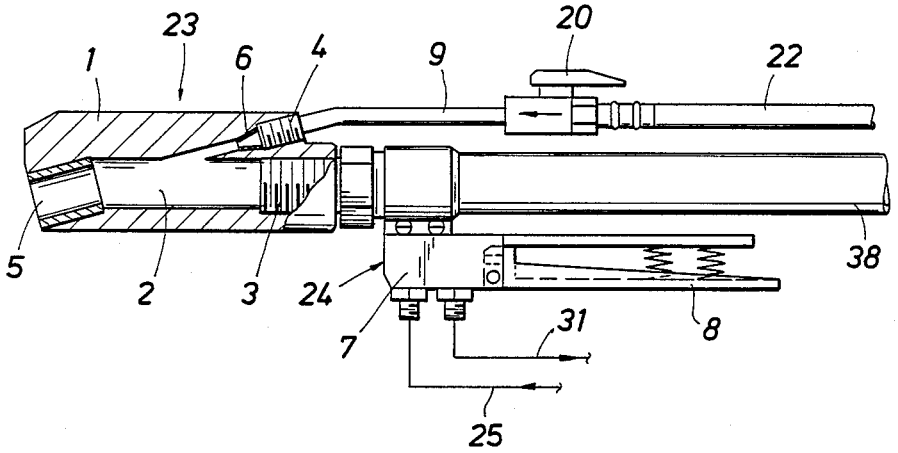
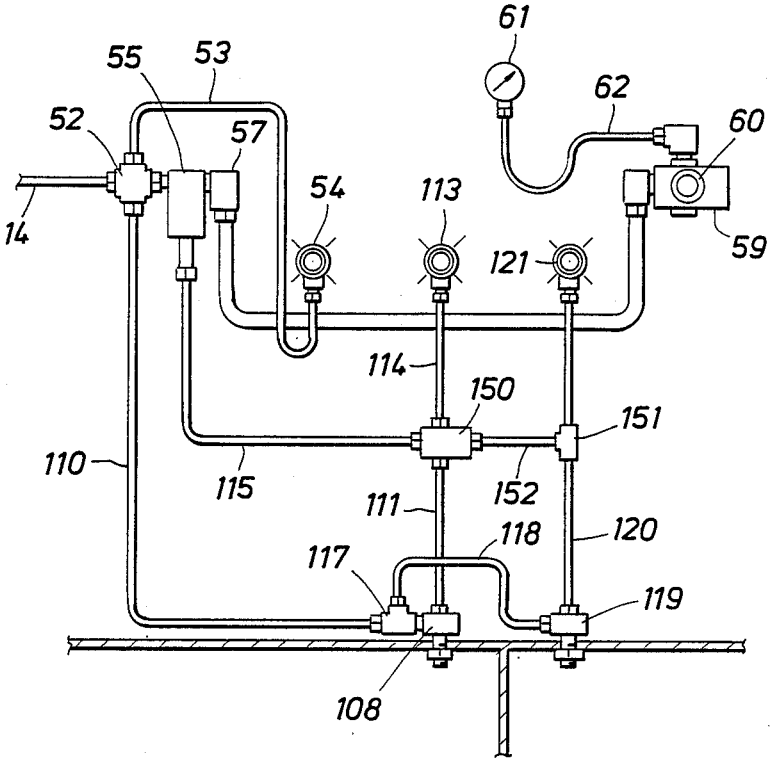
FIG. 4

CONTROL SYSTEM FOR LIQUID PROPELLED ABRASIVE CLEANING

FIELD OF THE INVENTION

This invention relates generally to a control system for use in connection with liquid-propelled abrasive blast nozzles by which rust, scale and other contaminants are removed from metal surfaces, and particularly to a new and improved control system that employs a unique system of fail-safe valves and deadman controls that provide for safe, faster and more effective cleaning than has been possible with prior devices.

BACKGROUND OF THE INVENTION

It is well known that a pressurized flow of abrasives can be employed to clean metal surface prior to painting or coating. The typical system uses compressed air to transport the abrasive, such as sand grains, through pipe and hoses to a nozzle that accelerates the abrasive against the surface of the object to be cleaned. Such object may be a pipe line, bridge, ship, floor, roof, railroad car or the like. More recent cleaning systems have used water in combination with an abrasive to suppress dust production and to wash the object as it is otherwise cleaned of contaminants.

However all such systems are believed to have a number of shortcomings. For example, prior systems have not, to applicants' knowledge had interlocked controls so that such systems could be started and stopped by a deadman-type control at the blast nozzle, and thus were somewhat unsafe and unreliable in operation. Other systems have not had any provision for saving the pump by shutting down its operation in case input water levels are low, so that the pump was subject to wear and high maintenance requirements. Still other systems have not had an optimum inhibitor injection system that worked automatically in association with the pump so that a proper amount of inhibitor is mixed with the water stream to prevent accidental flash rusting of the metal being cleaned. No system that applicants are aware of has had the capability to operate two blast nozzles independently of one another, and in multiple modes of operation depending upon the requirement of the particular cleaning operation. In summary, applicants believe that prior cleaning systems of the type to which this invention relates have not been constructed in a manner to provide safe, clean, fast and effective cleaning of contaminated metal surfaces, and it is to these general requirements that the present invention is directed.

It therefore is the general object of the present invention to provide a new and improved control system for a liquid-propelled abrasive cleaning apparatus that obviates the above-mentioned disadvantages of prior systems.

SUMMARY OF THE INVENTION

This and other objects are attained in accordance with the present invention through the provision of a cleaning system that includes a control module and a stripper machine that operate in combination with one another to provide improved blast cleaning of contaminated surfaces. The control module includes a portable housing having an upper compartment that houses various control valves and a pneumatically operable pump that is driven by air pressure from an external source such as a compressor, and a lower section that is divided into separate compartments that contain a water supply and an inhibitor chemical supply. Thus, the control module is completely self-contained. A pilot operated air valve is located in the line from the compressor, and is a normally-closed or fail-safe device that requires an air pressure signal in order to open and enable the pump to operate. Liquid level sensors are provided that prevent opening of the air valve unless there is an adequate water and/or inhibitor supply. A unique inhibitor injection system operates in synchronism with the pump to supply a precise quantity of inhibitor to the pump suction where it is mixed with the water that is being exhausted at high pressure by the pump.

The output of the pump is fed to one or more water valves having pneumatically actuated controllers to which an air signal must be applied by a deadman control at the blast nozzle in order to initiate high pressure water flow. In this manner the nozzle operator can stop nozzle operation as desired, and nozzle operation is automatically shut down if the nozzle is accidentally dropped. A complete system of indicators is provided on the module panel so that the various subsystems in the module can be continuously monitored with respect to proper operating pressures and system functions.

The blast machine includes a pressurized container for abrasives such as sand particles, which are fed through a metering and shut-off valve to a hose that leads to the blast nozzle. The supply of abrasives is under control of another pilot-operated air valve that receives an opening air signal from the deadman control so that the module and blast machine are interlocked in operation. Such air signal also controls the opening of the metering valve so that complete system shut down is assured unless the deadman control is depressed.

A second high pressure water outlet and deadman air signal input are provided at the control module, which are connected to a second water valve so that simultaneous, but independent, operation of two blast nozzles is provided. The manner in which the deadman control at the second nozzle controls flow of high pressure water, air and abrasive is the same as that set forth with respect to the first nozzle. In accordance with another unique aspect of the present invention, logic valves can be provided so that a blast nozzle will not operate unless there are adequate liquid levels in both the water and inhibitor compartments, and at least one deadman control is depressed. Unless these conditions are met, the pneumatic pump in the control module will not operate. Thus, it will be recognized that the present invention provides a fail-safe, reliable and more effective blast cleaning system than has been known heretofore.

BRIEF DESCRIPTION OF THE DRAWINGS

The present invention has other objects, features and advantages that will become more clearly apparent in connection with the following detailed description of a preferred taken in conjunction with the appended drawings in which:

FIG. 2 is a side elevation, with portions in section, of a blast assembly with deadman control;

FIG. 4 is a view similar to FIG. 3 of an alternative embodiment of liquid level controls and logic valve.

DETAILED DESCRIPTION OF A PREFERRED EMBODIMENT

Figure 1:
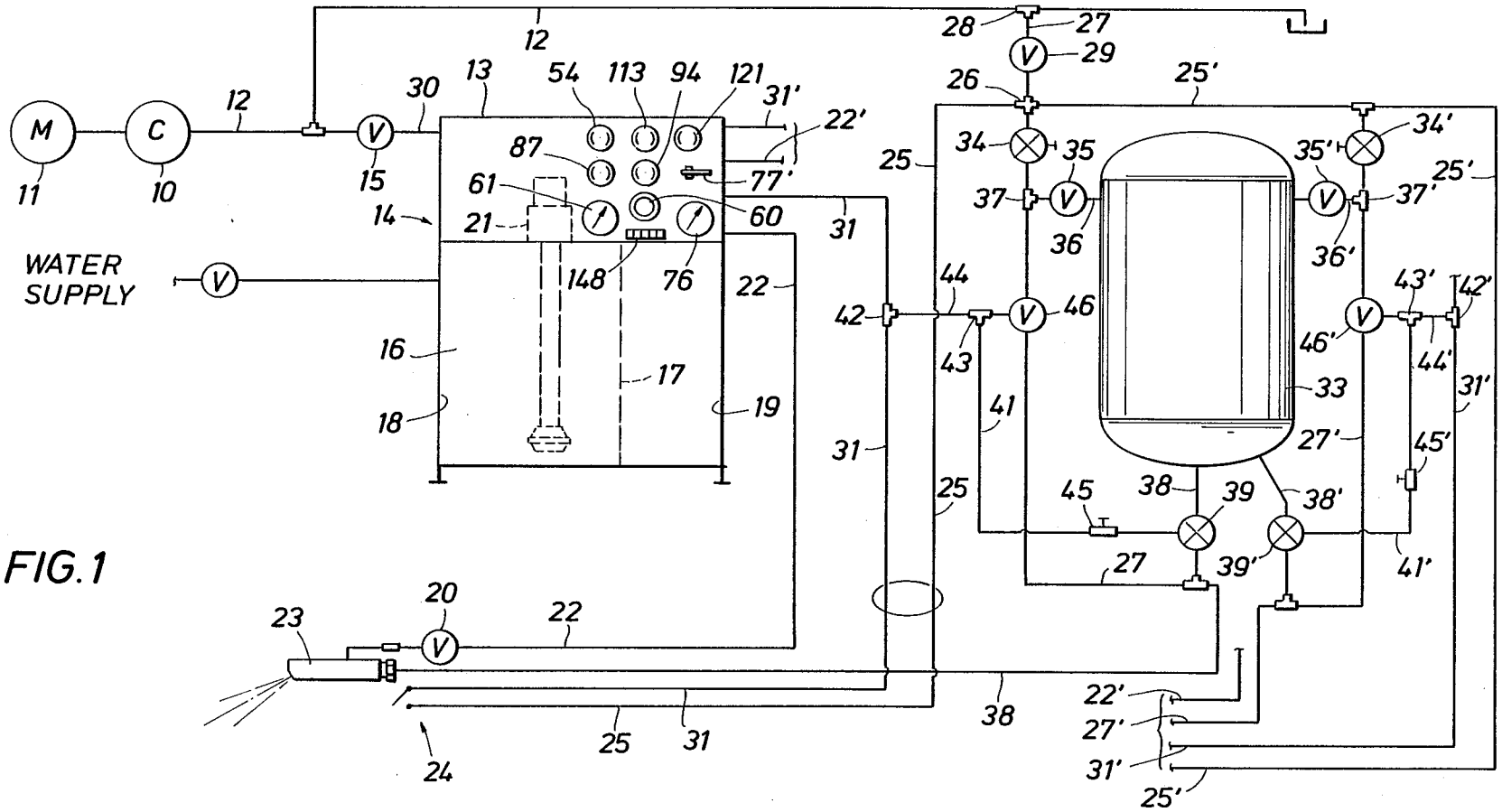
FIG. 1 is a schematic of a blast cleaning system having a control blast machine constructed in accordance with the present invention.

Referring initially to FIG. 1, a schematic of a liquid propelled abrasive cleaning system that embodies the various aspects of the present invention is shown. Since many of the component parts are conventional per se, manufacturer and model number are given in parenthesis. An air compressor 10 driven by a suitable engine 11 provides a supply of air under pressure to a line 12, preferably in a volume range of from 30–90 cfm, plus the approximately 180 cfm required for operation of each blast nozzle. Pressurized air is fed from the line 12 to the upper section 13 of a control station or cabinet 14 through a branch line 30 and through an air shut-off valve 15 (Whitney B-45XF8, 3-way). A supply of water is fed to the lower section 16 of the station 14, which comprises a storage tank having separate compartments for water and an oxidation inhibitor that are used in the liquid-sand blast cleaning operation. As an example, the lower section 16 of the station 14 can be partitioned by an internal vertical wall 17 shown in phantom lines, and the compartment dimensioned such that one side 18 holds about 30 gallons of water, and the other side 19 holds about 15 gallons of inhibitor. Appropriate dimensions for such volumes will be provided in a rectangular tank about 30 inches wide, 35 inches high, and 18 inches on the sides. Thus, the partition 17 would be located about 10 inches from the right side of the tank as shown in FIG. 1. Although several different inhibitor compounds could be used, a type of inhibitor is preferred that functions primarily to raise the ph level of the water such that the onset of any substantial or "flash" formation of rust is delayed to permit the clean metal to dry before a coating of paint or primer is applied.

Through operation of a pneumatically operable pump 21 (shown in phantom lines in FIG. 1; Speeflo No. 742-181) housed in the upper section 13 of the control station 14, water containing a positively controlled amount of inhibitor is fed under high pressure to a flexible output hose 22 that communicates with the inlet of a nozzle member 23. The hose 22 can be relatively long, for example 250 feet, to enable the operator to conduct cleaning operations a substantial distance away from the control station 14. A normally closed "dead-man" control valve (Shmidt 263 Pneumatic Deadman), indicated generally at 24, is mounted adjacent to the nozzle member 23 and functions to prevent operation of the nozzle unless the control valve 24 is being held open by the operator by depression of a spring-loaded actuator handle. In this manner, all flow of high pressure water and sand particles to the nozzle member 23 is automatically shut off when the operator releases the handle, or if the nozzle member is inadvertently dropped, as will be described in greater detail below. The inlet of the deadman valve 24 is connected by a flexible line 25 to a cross 26 in a line 27 that communicates with main air supply line 12 at tee 28. An air shut-off valve 29 is positioned in the line 27 between the tee 28 and the cross 26. The outlet of the deadman control valve 24 is connected by another flexible line 31 to an appropriate fitting on the side of the upper section 13 of the control station 14, whereby an air pressure signal is given to the control station 14 when the deadman valve 24 is actuated. The manner in which this signal acts to control the water supply in line 22 will be disclosed in detail below.

A suitable nozzle member 23 and deadman control valve 24 are shown in FIG. 2. The nozzle member 23, that is disclosed and claimed in copending application Ser. No. 739,500 filed May 30, 1985 includes a tubular body 1 having a propulsion chamber 2, an inlet 3 for sand particles, an inlet 4 for water, and an outlet 5 for a spray blast of water and propelled sand particles. An orifice 6 produces a high velocity water stream that intersects the stream of air and sand particles at a point that is upstream of the entrance to the outlet 5. The deadman valve 24 includes a body 7 that is secured to the hose 38 in a suitable manner, the body having an inlet for the line 25 and an outlet for the line 31 as shown. A spring-loaded handle 8 is pivoted to the body 7, and, when depressed by the operator, function to open a valve element within the body to communicate the line 25 with the line 31. When the handle 8 is released, the valve automatically closes to prevent communication of the line 25 with the line 31. A shut-off valve 20 connects the line 22 with a tube 9 that leads to the inlet 4.

Referring again to FIG. 1, a supply of abrasive particles, such as #3 sand, is contained in a tank or "pot" 33, sized to hold a suitable amount of abrasive, for example 1000 pounds. Air under pressure from the line 12 passes through a regulator valve 34, a shut-off valve 35 in a branch line 36 from tee 37 in line 27, and into the tank 33 through a suitable fitting, so that the tank 33 is under pressure. A sand supply hose 38 leads from the tank 33 to the sand inlet 3 of the nozzle member 23, and has a pilot-operated sand metering and shut-off valve 39 (Schmidt-Thompson valve) located therein adjacent the pot 33. The valve 39 is a normally closed device that is opened in response to air pressure in line 41, which is connected to the air signal line 31 by tees 42 and 43 and a branch line 44. A three-way valve 45 in the line 41 includes a bleed port to enable air pressure to be manually bled off when desired. The line 27 coming from the supply line 12 continues to a normally closed air valve 46 having a pneumatic operator connected to the line 44. Thus the valve 46 is opened only when there is an air pressure signal in line 31 due to opening of the deadman control valve 24, so that a metered mixture of sand particles and air is supplied to the line 38 only when the nozzle member 23 is in operation.

Another high pressure water outlet line 22' and an air pressure signal line 31' extend from the side of the upper section 13 of the control station 14, and these lines are associated with another nozzle member (not shown) so that two cleaning nozzles can be used by individual operators at the same time or independently of one another. For convenience of illustration, like components are given the same reference character with a prime designation. An air line 25' is connected to the cross 26 and feeds air under pressure via a regulator 34', a tee 37', a branch line 36' and a valve 35' to another inlet fitting on the sand pot 33. A line 27' coming off of the line 25' has a pilot controlled valve 46' therein, which is opened only when there is an air pressure signal in line 44' that is connected to air signal line 31' by a tee 42'. Abrasive particles, and air under pressure, are fed from the pot 33 by a hose 38' having a metering and shut-off valve 39' located therein as shown. The air pressure signal that causes valve 39' to open comes from line 41' via a three-way valve 45', the line 41' being connected to the line 44' by a tee 43'. The flexible conduits 25' and 31' lead to the respective inlet and outlet of a deadman control valve associated with the second nozzle which is the same as the nozzle construction shown in FIG. 2. The internal control components of the station 14 will now be disclosed.

Figure 3:
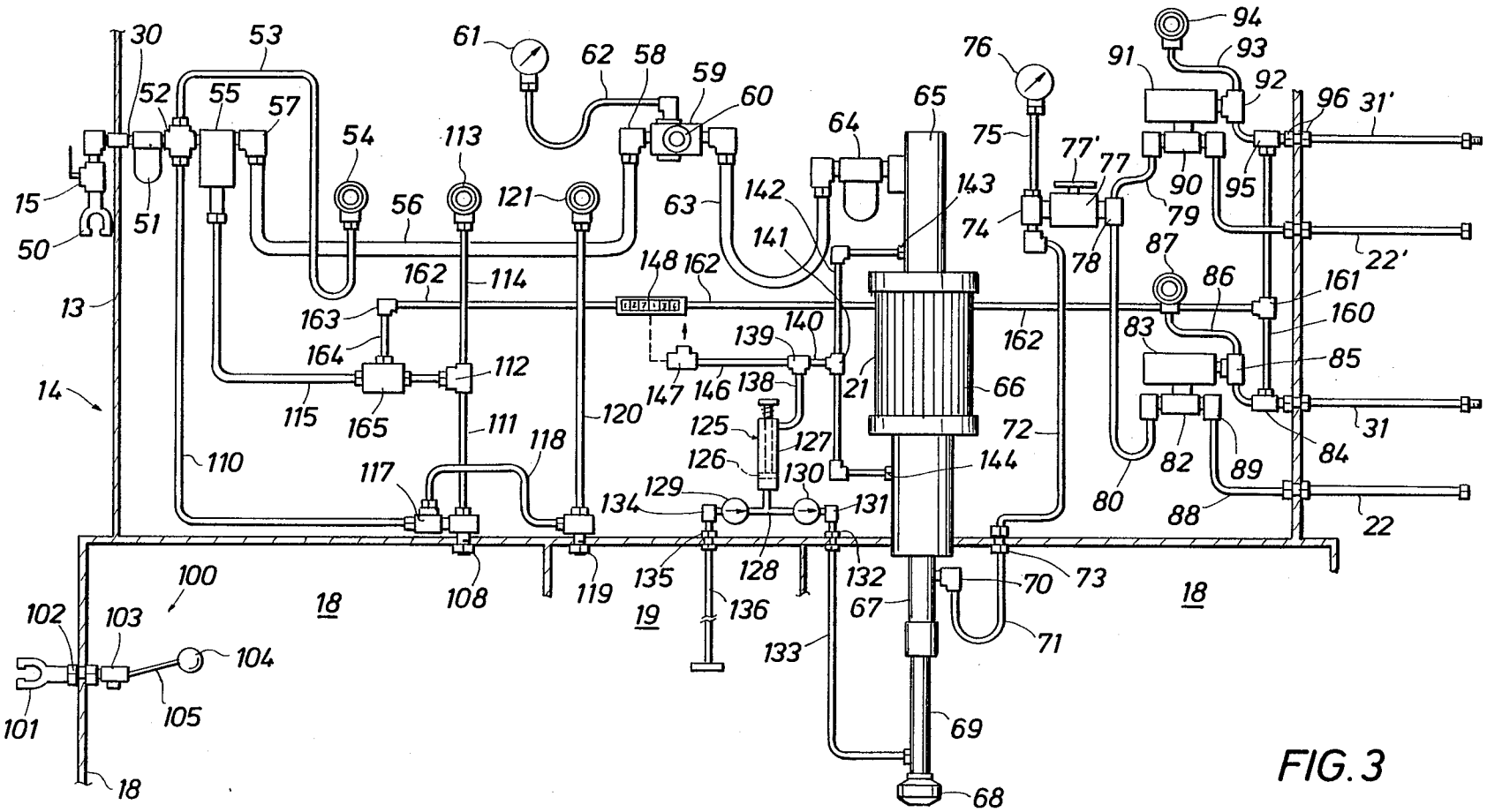
FIG. 3 is a layout view of the various components and systems with the control module or station of FIG. 1.

As shown in FIG. 3, which is a fragmentary, enlarged view of the interior of upper section 13 of the control station 14, compressed air from the compressor 10 comes in through a "crow's-foot" fitting 50 and the air shut-off valve 15, and goes through a filter 51 (Norgren F12-400-M3TA) to a cross 52. Air pressure is fed from the cross 52 via a line 53 to an indicator 54 that is positioned on the front face or panel of the control station upper section 13. The indicator 54 preferably is a device including a multi-colored ball that rotates to expose different colors to the viewer, depending upon whether air pressure is present in the line 53 or not. A pilot-controlled, automatic air valve 55 (Norgren D1024BA1 3-way air valve) also is connected to the cross 52, and an air hose 56 is connected by a fitting 57 to the outlet of the valve 55. The other end of the hose 56 is coupled by a fitting 58 to a pressure regulator 59 (Norgren R12-400-RNLA) that allows adjustment of both air pressure and flow rate. The amount of air pressure at the pump 21 is shown on a gauge 61 that is mounted on the front face panel of the station 14 (see FIG. 1), and which is connected to the regulator 59 by a hose 62. The outlet of the regulator 59 is supplied to a hose 63 which connects to an air lubricator 64 (Norgren L12-400-OLTA) on the inlet of the pneumatic pump 21. The pump 21, which is a conventional device, includes a slide valve section 65 and a piston section 66. The slide valve within the section 65 is shifted automatically in response to piston and rod position to supply air under pressure to alternate sides of the piston, which produces a continuous reciprocating motion of the piston and the rod attached thereto. A lower section 67 of the pump 21 extends down into the water contained in the tank compartment 18, and has a strainer 68 attached to the lower end of an extension tube 69. An exhaust tap 70 receives pressurized water out of the pump 21, and the water is supplied to a line 71 that leads to a hose 72 via fittings 73 on the upper wall of the compartment 18. The lower section 67 of the pump 21 includes a system of one-way check valves, of known construction, that enable water to be drawn into a cylinder and as pressurized water is being forced through the exhaust port 70, and which prevent water from returning from the cylinder to the tank. The hose 72 extends to a tee 74 having a high pressure hose 75 that leads to a pressure gauge 76, also mounted on the face of the panel as shown in FIG. 1. The other leg of the tee 74 is connected to a water valve 77 (Whitney SS-43F4 2-way manual) that is mounted on the panel with its actuator lever 77' exposed on the outside thereof.

The downstream side of the water valve 77 is connected to a tee 78 that is coupled to high pressure hoses 79 and 80 that lead toward the respective water outlet lines 22' and 22. The lower hose 80 connects to a water valve 82 (Whitney 22-4F4 2-way valve with pneumatic operator) having a pneumatically actuated controller 83. The valve 82 is normally closed, and is opened by the controller 83 only when air pressure is present in the line 31 which is connected thereto by fittings 84, 85. The upper end of the tee 85 is connected by a hose 86 to an indicator 87 mounted on the front of the panel. This indicator is similar to that previously described, in that a particular color is exposed depending upon whether there is air pressure in the line 86, which in turn provides an indication of the open or closed condition of the valve 82. The valve 82 is connected to water line 22 by a hose 88 and an ell 89.

The upper hose 79 connects to an identical valve system that controls the supply of high pressure water to the outlet line 22' which leads to the second nozzle member as described above. The system includes a valve 90, a pneumatic actuator 91, tee 92, hose 93 and indicator 94. The lower side of the tee 92 is connected by a the 95 and, fittings 96 to the inner end of the air signal hose 31', which leads to the deadman control valve at the second nozzle.

In order to maintain the water in the tank compartment 18 at the proper level, a float arrangement indicated generally at 100 is provided. Water under pressure coming from a suitable source such as a pump or hydrant goes through connector 101 and a bulkhead fitting 102 to a float valve 103 that opens when a float 104 on an arm 105 falls with the water level. Water then will enter the compartment 18 until the float 104 rises by an amount sufficient to shut off the valve 103.

In order to protect the pump 21 by preventing its operation when the water level is too low in the compartment 18, an air float switch valve 108 (Clippard Minimatic 3-way valve) can be used. The valve 108 has a tube (not shown) that extends down into the water in the compartment 18. As long as the water level is sufficiently high, the water rising in the tube generates a pressure therein that maintains the valve open so that air pressure in line 110, which leads from cross 52, can reach line 111 via valve 108. A tee 112 in the line 111 branches air pressure to indicator 113 via hose 114, and to air valve 55 via hose 115. The indicator 113 (on the panel face) thus will have a color indicative that the water level in the tank 18 is sufficient because there is air pressure in line 114. If the water level falls below a predetermined value, the valve 108 will close so that air pressure in line 110 is blocked. Lines 111 and 115 are bled to zero to cause air valve 55 to close and present the air supply from reaching the pump 21. The indicator 113 also will change color to provide a visual indication to the operator that the water level is low.

As an alternative, an arrangement including a float and an arm could be used to actuate the valve 108, similar to that system described in connection with the water inlet system 100. Any suitable liquid level actuated pneumatic switch could be employed.

A tee 117 is placed in the line 110 upstream of the valve 108, and a branch line 118 leads to another air switch valve 119 identical to valve 108. A hose 120 leads to another indicator 121 on the face panel as shown in FIG. 1. The sensor from the valve 119 extends into the inhibitor compartment 19, and the inhibitor level controls the condition of the valve 119 in the manner discussed above. With the valve 119 open, the indicator 121 will be one color when the level of inhibitor is sufficient, and will change to another color due to the absence of air pressure in line 120 when the inhibitor level is too low. Thus the operator is warned to add inhibitor liquid to the tank 19 at the appropriate time.

Another embodiment of the present invention, where a logic circuit is used to provide total shutdown of the system when either the water level in compartment 118 or the level of inhibitor in compartment 19 is too low, is shown in FIG. 4. In this embodiment the tee 112 is replaced by a logic valve 150 such as a Clippard Model 2010 Fluidic Interface valve. A tee 151 is placed in the line 120, and is connected to the valve 150 by a line 152. Thus arranged, unless both the switch valves 108 and 119 are open due to sufficient levels of liquids in the compartments 18 and 19, air pressure in 110 is not transmitted to the air valve 55, which remains closed so that the system is shut down.

In accordance with another feature of the present invention, a positive displacement injection system is provided for injecting inhibitor chemical into the water pump intake, with injection being synchronized with the pump stroke. As shown in FIG. 3, the system includes a small syringe-type injector 125 (Bimba Miniature Cylinder, ¾" dia. ×2" stroke) having a spring-loaded piston 126 that works within a cylinder 127. The lower end of the cylinder 127 is provided with a tee 128 that has one-way check valves 129, 130 on its opposite ends. The check valve 130, which opens outwardly, is connected by an ell 131, fittings 132, and a line 133 to the pump extension tube 69 just above the strainer 68. The check valve 129, which opens inwardly, is connected by ell 134, fittings 135, and a line 136 to the interior of the inhibitor tank 19. The upper side of the piston 126 is connected by a line 138, a tee 139, and another line 140, to a tee 141 located centrally in a sensor conduit 142 that is connected at 143 and 144 to the respective opposite sides of the pump piston chamber within element 21. On each discharge stroke of the piston of the pump 21, a small volume of inhibitor chemical is drawn into the cylinder 127 from the tank 19 through the line 136 and the check valve 129, the check valve 130 being closed. On each suction stroke of the pump piston, the check valve 129 closes, and a discrete quantity, say 0.250 cubic inches, of inhibitor chemical is injected into the pump intake tube 69 though the check valve 130 and the line 133.

If desired, a line 146 can extend from the tee 139 to a quick-dump valve 147 that is coupled to a counter 148. The counter 148 advances one unit on each pressure change, and provides a readout or display of the number of strokes of the pump 21 and the injector 112 as a cleaning operation proceeds. The counter 148 is mounted on the front panel as shown in FIG. 1, so as to be readily visible to the operator.

In accordance with a further feature of the present invention, the hydraulic circuits can be arranged such that at least one of the deadman control valves 24 must be open, or else the air valve 55 will be closed to prevent operation of the pump 21. As shown in FIG. 3, the air signal line elements 95 and 84 are communicated by a conduit 160 having a tee 161. A line 162 runs from the tee 161 to an ell 163 and a nipple 164 to a valve 165 that is placed in the air line 115. The valve 165 is a pilot operated "either-or" 3-way valve, so that if there is no air signal on line 162, which would be case unless at least one of the deadman control valves 24 is open, the pump 21 can not operate because the valve 55 remains closed.

OPERATION

In operation, the air compressor 10 is driven by the engine 11 to produce a supply of pressurized air on the line 12. The air supply goes through valve 15 and filter 51 to the pilot controlled valve 55 which is closed unless there is air pressure in line 115. If (and only if,) there is a sufficient water level in the tank 18, the sensor valve 108 will be open to communicate line 110 with lines 111 and 115, to thereby supply air pressure to the pilot inlet of valve 55 so that it can open. When open, compressed air passes through line 56, regulator 59 and line 63 to the air port of the pump 21. The compressed air causes the pump piston and its associated rod to reciprocate within the housing. On each suction stroke, water in the tank 18 is drawn into the pump cylinder through the screen 68, and on each discharge stroke water is supplied under high pressure to the lines 71 and 72. Provided that valve 77 is open, pressurized water goes into lines 80 and 79 and is available at water control valves 82 and 90. The valves 82 and 90 are normally-closed devices, and can be opened only when a pneumatic control signal is applied to the respective actuators 83 and 91.

Each time the pump 21 strokes upward, air pressure enters line 142 and is communicated to cylinder 127 to force piston 126 downward and inject a shot of inhibitor fluid through the check valve 130 and the line 133 into the tube 69 in order to mix with incoming water. Each time the pump 21 strokes downward, the air pressure in line 142 (and thus on the piston 126 and in the cylinder 127) drops to near zero and the spring draws piston 126 upward, drawing in another small quantity of inhibitor chemical below the piston 126 of the injector pump 125 via the intake line 136 and the check valve 129. Thus a positively controlled amount or volume of inhibitor is mixed with the blasting water during operation of the pump 21.

As shown in FIG. 1, air under pressure in line 12 goes to the deadman control line 25 via line 27, valve 29 and tee 26. So long as the control valve 24 is closed as shown, there is no air pressure in the line 31, and hence the water valve 82 is closed so that high pressure water can not reach the nozzle member 23. Without pressure in the line 31, there also is no pressure in either of the lines 44 and 41, so that the pilot operated sand metering valve 39 and the pilot operated air flow valve 46 remain shut off. Thus, neither sand particles nor can compressed air flow through the hose 38 toward the nozzle member 23.

The deadman control valve 24, which as previously mentioned is spring-loaded to be normally closed, must have its actuator handle 8 depressed by the operator in order to bring the nozzle member 23 into operation. With the valve 24 open, air pressure in the line 25 is communicated to the line 31 as a control signal to the actuator 83 of the water valve 82, causing the valve to open. High pressure water then is fed to the line 22 that extends to the nozzle 23. The air pressure in line 31 also passes through lines 44 and 41 to open valve 46 and valve 39. Sand particles, which are under pressure in the pot 33, then can be transported by compressed air passing through valve 46 and through the hose 38 to the nozzle member 23, where they are impacted by the high velocity water stream in the propulsion chamber 2 of the nozzle member to produce a high pressure blast spray that emanates from outlet 5 in the body 1. The spray cleans a metal surface against which the spray is directed in a highly effective manner.

The operator can stop the operation of the nozzle member 23 by releasing the handle 8 of the control valve 24, or the operation of the nozzle member is automatically stopped if the operator should accidentally drop the nozzle member for one reason or another. Since both water, air and sand flow to the nozzle member 23 are automatically shut off, a fail-safe safety system of remote controlled valves is provided.

As previously mentioned, the water pump 21 can not be operated unless there is an adequate supply of water in the tank compartment 18, because the valve 55 can not be opened unless the water level is sufficiently high to trigger the opening of the valve 108.

Whether there is air pressure in the incoming line 14 is indicated on the panel by the element 54, which will present, for example, a green color if pressure is present, and another color such as red if pressure is absent. The indicator element 113 shows red if the valve 108 is closed (low water level), or green if there is pressure in the lines 111, 115, 114 to cause opening of the valve 55. The indicator element 121, in like manner, shows whether there is an adequate level of liquid in the inhibitor chemical compartment 19.

The pressure regulator valve 59 also is mounted on the panel so that its adjustment knob can be manually set as shown at 60. The valve 59 can be set for operation at 20, 40 or 60 psi air supply pressure to the pump 21, for example, whereby the system can be set to operate at reduced noise levels by adjusting valve 34 in congested areas where the noise level can be a problem. The operating pressure just downstream of the regulator valve 59 is indicated by the gauge 61 on the panel. Pump discharge water pressure is indicated on the gauge 76.

The other indicators 87 and 94 also are mounted on the panel. The indicator 87 will show one color, for example, black, when there is no air pressure in the signal line 31, indicative of the fact that the deadman valve 24 is closed, as well as the water valve 82. When air pressure is present in the line 31, the indicator will present another color, for example yellow, to signal that valves 24 and 82 should be open. The other indicator 94 is connected to the line 48 to provide identical information with respect to a second nozzle member that may be connected to the system.

By way of summary, the present invention affords a number of advantages due to the various unique features thereof. A fail-safe, high pressure water supply is provided to a cleaning nozzle, which is adjustable in pressure and volume. The nozzle member is interlocked with respect to operation of the supply system, so that the two components are simultaneously operable under the control of a "dead-man" instrumentality. The blast system can be used to operate one nozzle, or two nozzles can be operated independently of one another. A unique water level sensor includes a pilot-operated valve that prevents operation of the pump unless sufficient water is present in the tank. The use of a pneumatic pump and control system provides safe and reliable mechanisms with no potential spark production that could cause ignition of a fire. For this same reason, it is preferable to drive the air compressor 10 with a diesel engine having compression rather than electrical ignition. Since compressed air is the driving medium for the pump, the system can be used in remote areas where electric power is unavailable, or is undesirable for safety reasons. Overall, the present invention is less expensive to manufacture and to maintain, since it is considerably less complicated than other systems.

The combination of indicators and gauges on the panel provides the operator with complete diagnostics in the event the system is not operating properly. The operator is able to tell exactly where in the system a problem lies, so that corrective action can be taken promptly. All controls operate at full line pressure. Level sensors are provided which positively prevent operation of the system unless water and inhibitor levels are adequate. In fact, there also must be at least one deadman control valve that is open for the pump 21 to operate.

The pressure regulator 59 allows adjustment of both pressure and flow rate. In a preferred embodiment, there is a 30:1 pump outlet pressure to air pressure ratio. The present invention is compatible with any dry blast system, and provides two nozzles that can be operated independently. Due to the interlocked control features, the pump is saved by positive shut-off of its air supply unless at least one deadman switch is activated so that there is no slow leak of water, as in some prior systems of this general type. The present invention is completely self-contained with built-in water and inhibitor chemical tanks. Inhibitor injection is positively interlocked to the pump 21 air motor in operation, so that definite quantities of inhibitor are mixed with the water to prevent oxidation of the clean metal prior to drying and painting.

The present invention can be operated in any one of five different modes as follows:

(1) air, water and abrasive: valves 20, 45 and 29 all open. This mode is useful for high pressure water-sand blast cleaning of rusted metal surfaces.

(2) air and water, valve 45 manually turned off to prevent opening of sand valve 39. This mode is useful in flushing off surfaces having foreign particles, salt deposits, or liquids thereon.

(3) water only: valves 20 and 45 turned off. This mode provides a water broom effect.

(4) air only: valves 29 and 45 closed. This mode is used for drying a previously cleaned surface prior to painting or coating.

(5) air and abrasive: valve 20 closed. In this mode, the apparatus can be used for dry sand blasting operations.

It now will be recognized that a new and improved cleaning apparatus has been disclosed. Certain changes or modifications can be made in the disclosed embodiment without departing from the inventive concepts involved. For example, the deadman control could take the form of a normally open electrical switch across the ends of a pair of conductor wires that lead to the terminals of a battery associated with the compressor engine. A solenoid valve connected in one wire could control the air pressure signal to the water valve and the sand pot assembly via tee 42. It therefore is the aim of the appended claims to cover all such changes and modifications falling within the true spirit and scope of the present invention.

What is claimed is:

1. Liquid-propelled abrasive cleaning apparatus comprising: nozzle means for applying a high pressure stream of water and propelled sand particles to a surface to be cleaned; pump means for furnishing water under high pressure to said nozzle means, said pump means being of a kind which may be driven by a pressurized fluid medium and having a discharge outlet; first conduit means for connecting said outlet to said nozzle means; second conduit means for delivering said medium to said pump means; normally closed valve means in said first conduit means; pneumatic actuator means for opening said valve means; and control means disposed in proximity with said nozzle means for enabling pressure to be applied to said actuator means to open said valve means only when said nozzle means is in use.

2. The apparatus of claim 1 further including tank means containing a supply o water, and means including a liquid level sensor means for automatically interrupting the supply of said medium to said pump means when water in said tank means falls below a predetermined level.

3. The apparatus of claim 2 wherein said interrupting means includes a pilot-operated valve responsive to pressure to move from a normally closed position to an open position; and switch means for preventing opening of said pilot-operated valve unless said liquid level is adequate.

4. The apparatus of claim 1 wherein said pump means further includes a suction inlet, said apparatus further including inhibitor injection means for supplying discrete quantities of inhibitor to said water at said suction inlet of said pump means; and means associated with said pump means for operating said injector means in synchronism with said pump means.

5. The apparatus of claim 1 further including enclosed container means having abrasive particles under pressure therein; and abrasive supply hose connected between said container means and said nozzle means for delivering air and abrasive particles thereto; a metering valve in said hose; third hose means in communication with said control means for enabling pressure to be applied to said metering valve thereby opening it and allowing said abrasive particles to flow to said nozzle means only when said nozzle means is in use.

6. The apparatus of claim 5 further including a common supply line for feeding a pressurized fluid to said pump means, said control means, and said container means.

7. Liquid-propelled abrasive cleaning apparatus comprising: a housing having a compartment for holding a supply of water; pneumatically operable pump means for taking water from said compartment and supplying it under high pressure to a blast nozzle; first conduit means for supplying air under pressure to said pump means to operate the same; normally closed valve means in said first conduit means for shutting off the supply of air to said pump means, said valve means being opened in response to an air pressure signal; second conduit means connected to said first conduit means upstream of said valve means and through which said air pressure signal is supplied to said valve means; switch valve means connected in said second conduit means; and sensor means associated with said switch valve means for preventing application of said air pressure signal to said normally closed valve means unless the water in said compartment in above a predetermined level.

8. The apparatus of claim 7 further including a regulator means in said first conduit means between said normally closed valve means and said pump means for permitting adjustment of the presence of air being supplied to said pump means.

9. The apparatus of claim 7 further including another compartment within said housing adapted to contain an inhibitor chemical; injection means operable in response to said pump means for feeding a fixed amount of such chemical into said water at the suction end of said pump means.

10. The apparatus of claim 9 wherein said injector means includes piston and cylinder means, means for communicating pressure changes that occur during operation of said pump means to said piston and cylinder means to cause reciprocation of said piston means within said cylinder means, and line and check valve means for drawing chemical from said compartment and feeding same to the suction of said pump means during reciprocation of said piston means within said cylinder means.

11. The apparatus of claim 10 further including means for displaying the cumulative number of strokes of said piston means as a monitor of the usage of said pump means.

12. The apparatus of claim 9 further including additional switch valve means connected in said second conduit means; and additional sensor means associated with said additional switch valve means for preventing application of said air pressure signal to said normally closed valve means unless the level of said chemical in said other compartment is above a predetermined level.

13. The apparatus of claim 12 further including logic valve means in said second conduit means for permitting said pilot controlled valve means to remain closed unless there are adequate levels in both of said compartments.

14. The apparatus of claim 12 further including logic valve means in said second conduit means; means for supplying high pressure water from said pump means to said blast nozzle; deadman control means associated with said blast nozzle for providing an air pressure signal only when said control means is activated; and means for communicating said air pressure signal to said logic valve means, said logic valve means permitting said pilot controlled valve means to remain closed unless there are adequate liquid levels in each of said compartments and an air signal is being received from said deadman control means.

15. The apparatus of claim 7 further including third conduit means for connecting said pump means to a blast nozzle in a manner to supply water under high pressure thereto; normally closed water valve means in said third conduit means, said water valve means being opened in response to an air pressure signal; and deadman control means for supplying said air pressure signal to said water valve means.

16. The apparatus of claim 15 further including logic valve means in said second conduit means, said logic valve means being closed unless said switch valve means are open and said air pressure signal is being received from said deadman control means.

17. The apparatus of claim 15 further including an enclosed container having abrasive particles such as sand therein; an abrasive supply .hose connected between said container means and said blast nozzle for delivering air and abrasive particles thereto; means for pressurizing said container; metering valve means movable between positions closing and opening said hose responsive to an air pressure signal; air means connected with said deadman control means for applying said air pressure signal to said metering valve means.

18. The apparatus of claim 17 further including an air line connecting said pressurizing means to said hose at a location underneath said metering valve means; second normally closed valve means in said air line, said second valve means being opened in response to an air pressure signal; and means connected with said deadman control means for applying said air signal to said second valve means only when said blast nozzle is in use.

19. Liquid-propelled abrasive cleaning apparatus comprising: a housing having a compartment for holding a supply of water; pneumatically operable pump means for taking water from said compartment and supplying it under high pressure; first conduit means for supplying air under pressure to said pump means to operate the same; normally closed air valve means in said first conduit means for shutting off the supply of air to said pump means, said valve means being opened in response to an air pressure signal; second conduit means connected to said first conduit means upstream of said valve means and through which said air pressure signal is supplied to said valve means; means for preventing application of said air pressure signal to said air valve means unless water in said compartment is above a predetermined level; first supply means including a first normally closed water valve for supplying water at high pressure from said pump to a first blast nozzle; second supply means including a second normally closed water valve means for supplying water at high pressure to a second blast nozzle; each of said nozzles having a deadman control disposed in proximity with each of said nozzles for providing air signals to said water valves to open the same only when said deadman controls are activated.

20. The apparatus of claim 19 wherein said preventing means includes a logic valve means to which an air signal from at least one of said deadman controls must be applied to enable opening of said air valve means and operation of said pump means.

21. The apparatus of claim 19 wherein said housing has another compartment adapted to contain an inhibitor chemical, and further including injector means for supplying inhibitor chemical for mixing with said water; and means for operating said injector means in synchronism with said pump.

22. The apparatus of claim 21 further including additional means for preventing application of said air pressure signal to said air valve unless inhibitor chemical in said other compartment is above a predetermined level.

23. The apparatus of claim 22 further including a logic valve means for permitting said air valve to remain closed unless there are adequate levels of liquid in each of said compartments.

24. The apparatus of claim 19 further including enclosed container means having abrasive particles under pressure therein; abrasive supply hoses connected between said container means as said respective nozzles for delivering air and abrasive particles thereto; metering valve means in each of said supply hoses and movable between positions closing and opening same in response to an air pressure signal; said air signals from said respective deadman controls being supplied to respective metering valve means to open same only when said deadman controls are activated.

25. The apparatus of claim 24 further including air lines connecting said pressurizing means to said respective hoses at locations underneath said metering valve means; normally closed shut-off valves in said air lines, said shut-off valves being opened in response to an air pressure signal; air means connected with said deadman controls for applying air pressure signals to said shut-off valves only when said blast nozzles are in operation.

26. The apparatus of claim 25 further including a first manually operated shut-off valve in said air line; and a second manually operated shut-off valve in said water supply means, whereby a plurality of modes of operating said apparatus can be selected by the operator, depending upon the open or closed setting of said first and second manually operated valves and said shut-off valves in said air lines.

* * * * *